United States Patent [19]

Lemaster

[11] Patent Number: 5,018,956

[45] Date of Patent: May 28, 1991

[54] CAULK AND GLAZING TOOL

[76] Inventor: Guy N. Lemaster, 9090 Cooley Lake Rd., Union Lake, Mich. 48386

[21] Appl. No.: 558,310

[22] Filed: Jul. 26, 1990

[51] Int. Cl.[5] ..... B32B 15/08

[52] U.S. Cl. ..... 425/87; 15/235.7; 425/458

[58] Field of Search ..... 425/458, 87; 15/235.7, 15/236.01; D8/10, 45, 14.1

[56] References Cited

U.S. PATENT DOCUMENTS

| | | | |
|---|---|---|---|
| 1,643,856 | 9/1927 | Romero | 15/236.01 |
| 2,879,530 | 3/1959 | Ego | 15/236.01 |
| 3,846,060 | 11/1974 | Otis | 425/458 |

OTHER PUBLICATIONS

Millers Falls Company Catalog, No. 42 (1938) p. 15.

Goodman, W. L., *The History of Woodworking Tools;* (1964), pp. 78–79, 101, G. Bell and Sons, Ltd., London (Publishers).

*Primary Examiner*—Jay H. Woo

*Assistant Examiner*—William J. Matney, Jr.

*Attorney, Agent, or Firm*—Barnes, Kisselle, Raisch, Choate, Whittemore & Hulbert

[57] ABSTRACT

A glazing tool which has a handle plate to be gripped between the thumb and forefinger of an operator. Two spaced trim blades have runner edges disposed at an angle to handle plates to trim the bead of glazing material. These runner edges angle toward the distal end of the back plate where a bead contact blade is disposed transversely of the runner edges. Perforate side wings proximal to the bead contact blade rise upwardly and outwardly of the trim blades to guide trimmed glaze material away from the tool.

2 Claims, 1 Drawing Sheet

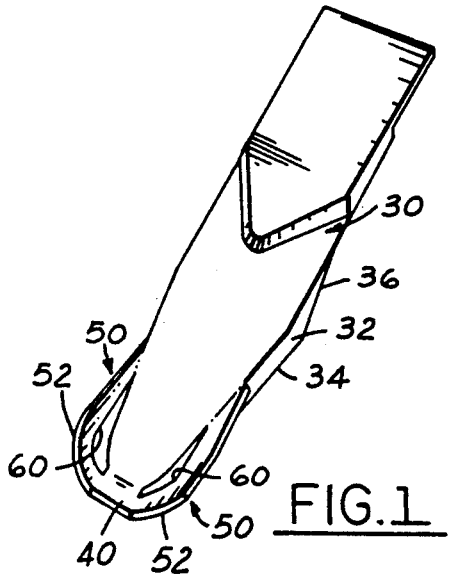
FIG.1
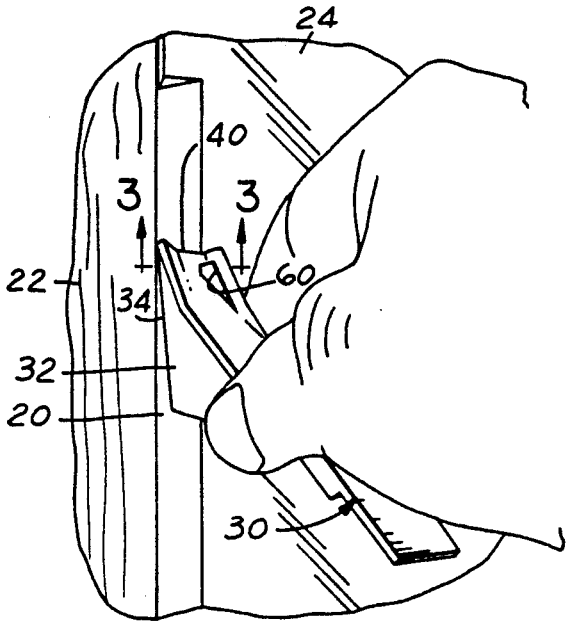
FIG.2
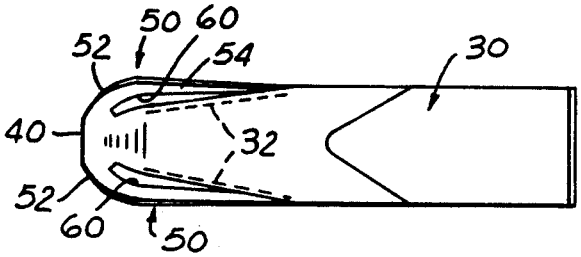
FIG.4
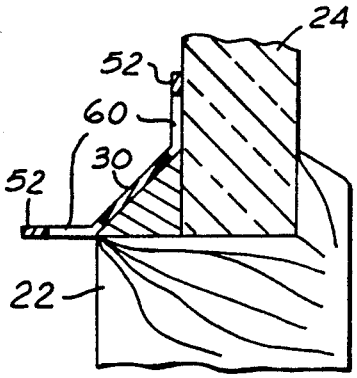
FIG.3
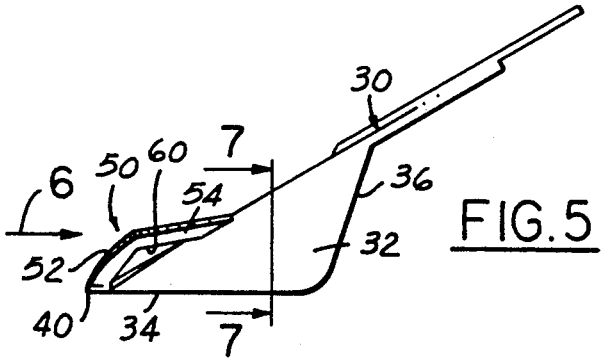
FIG.5
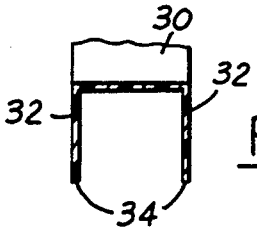
FIG.7
FIG.6
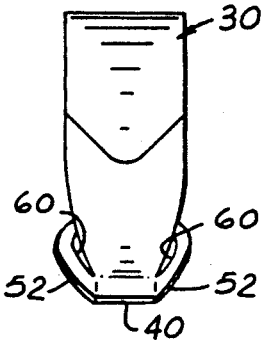

CAULK AND GLAZING TOOL

FIELD OF INVENTION

Tools for shaping and smoothing putty and caulk in ninety-degree corners.

BACKGROUND AND OBJECTS OF THE INVENTION

In the application of a putty or caulking bead at the juncture of an angularly disposed pair of walls or against a glass pane, considerable difficulty is encountered by the craftsman as well as the unskilled in shaping, packing and troweling the mastic caulking compounds to form a straight and clearly defined bead. The problem largely arises due to the fact the initial extrusion of caulk or putty as from a collapsible tube or a caulking gun or as applied by hand is irregular in shape and generally involves an excess of caulk. The removal of the excess by wiping or scooping with a putty knife or similar tool is often accompanied by disruption of the desired applied bead in the juncture being caulked. Various kinds of corner-finishing tools are known from U.S. Pat. Nos. 2,193,390; 2,271,285; 3,087,654 and 3,846,060. These, however, have not been found capable of troweling a bead in a right-angle corner and displacing during the troweling any excess caulk to locations where it can be easily removed, it being the primary object of this invention to do so.

Another object of this invention has been the provision of a tool that may be accurately aligned between a pair of right-angle surfaces and in movement longitudinal of the juncture therebetween be smoothly guided and supported thereby.

Still another object is the provision in such a troweling tool of resilient scraping and troweling means whereby pressure is applied to the mastic caulk during troweling to insure filling and to expel entrapped air or gas bubbles.

An object of the present invention is to provide an improved cornering tool which will smooth and trim putty or caulk in a 90° crevice while removing excess material leaving the 45° strip intact and pressed firmly in place.

Caulk or putty usually has an oil binder which will cling to wood and glass when pressed firmly into the 90° corner intended for it. The glazing tool of the present invention is easily manually manipulated to be drawn along the applied putty to angle it properly and leave a smooth surface.

Objects and features of the invention will be apparent in the following description and claims in which the invention is set forth together with details to enable persons skilled in the art to practice the invention all in connection with the best mode presently contemplated for the invention.

BRIEF DESCRIPTION OF THE DRAWINGS

DRAWINGS accompany the disclosure and the various views thereof may be briefly described as:

FIG. 1, a perspective view of the smoothing tool angled in a work position.

FIG. 2, a view of the smoothing tool as applied to a glazing function.

FIG. 3, a sectional view on line 3—3 of FIG. 2.

FIG. 4, a plan view of the tool.

FIG. 5, a side elevation of the tool.

FIG. 6, a top view of the tool on arrow 6 of FIG. 5.

FIG. 7, a section on line 7—7 of FIG. 5.

DETAILED DESCRIPTION OF THE INVENTION AND THE MANNER AND PROCESS OF USING IT

With reference to the drawings, the glazing tool is illustrated in FIG. 2 held between the thumb and forefinger and being applied to a strip of putty 20 between a sash piece 22 and a glass pane 24. A handle or back plate portion 30 has, on each side, depending shoe plates 32. These shoe plates each have a runner edge 34 disposed at an angle to the plane of the back plate 30, the angle being 30° to 45°. The trailing edges 36 of the runners rise to the back plate 30. These shoe plates 32 are cutter blades preferably in spaced planes which converge at an apex of the shoe plates toward the forward distal end of the back plate to form a blade contact end. The blade end 40 of the back plate will be in direct contact with the bead of putty 20 when being drawn along the bead.

On each side of the blade end of the back plate 30 and rising from the shoe plates 32 are angled wings 50 each comprising a narrow lead piece 52 which rises from the plane of the runner edges 34 and flares upwardly and outwardly as shown best in FIGS. 4 and 5. Integral with these lead pieces 52 are rearwardly extending connectors 54 which extend to the sides of the back plate 30. Triangular apertures 60 thus are formed by the wings 50 open to the outside of the shoe plates 32.

As illustrated in FIG. 2, the tool is grasped between the thumb and forefinger and drawn rearwardly while being pressed down over a bead of putty 20. The runners on the blades 34 will trim the sides of the bead and any excess trim will feed out of the openings 60 away from the tool where it can be readily recovered and restored to the basic supply of putty.

What is claimed is:

1. A tool for smoothing and shaping glazing material in a trowelling operation on windows which comprises:

(a) a flat handle plate for manual gripping lying in a first plane and having a distal and a proximal end, (b) spaced shoe plates depending from each side of said handle plate having spaced, elongate bottom runner edges extending rearwardly from the distal end of said handle plate and disposed at a 30° to 45° angle to the plane of said handle plate to trim glazing material at the runner edges, (c) a smoothing blade transverse of said handle plate at the distal end of said handle plate essentially at the apex of the angle between the plane of the handle plate and the runner edges of the shoe plates, and (d) spaced side wings flaring upwardly and outwardly from each side of said smoothing blade above the runner edges of said shoe plates and extending rearwardly toward the proximal end of the handle plate, said side wings having elongate perforations above said runner edges within the confines of said wings to feed excess trimmed glazing material away from the smoothing blade.

2. A tool as defined in claim 1 in which the runner edges of said spaced shoe plates lie in spaced planes diverging from the distal end of the handle plate toward the proximal end and said perforations extend above and in the same direction as said runner edges.

* * * * *